United States Patent [19]

Tate et al.

[11] Patent Number: 4,989,648

[45] Date of Patent: Feb. 5, 1991

[54] SINGLE-LAYER PAPERMAKING FABRIC HAVING A FLAT SURFACE OF AUXILIARY WEFTS

[75] Inventors: Takuo Tate; Taketoshi Watanabe; Hiroyuki Nagura, all of Tokyo, Japan

[73] Assignee: Nippon Filcon Co., Ltd., Tokyo, Japan

[21] Appl. No.: 399,212

[22] Filed: Aug. 29, 1989

[30] Foreign Application Priority Data

Aug. 31, 1988 [JP] Japan ..... 63-215023

[51] Int. Cl.[5] ..... D03D 15/00

[52] U.S. Cl. ..... 139/383 A; 162/DIG. 1

[58] Field of Search ..... 162/DIG. 1, 348, 358; 428/257; 139/383 A, 425 A

[56] References Cited

U.S. PATENT DOCUMENTS

| | | | |
|---|---|---|---|
| 4,281,688 | 8/1981 | Kelly et al. | 139/383 A |
| 4,423,755 | 1/1984 | Thompson | 139/383 A |
| 4,729,412 | 3/1988 | Bugge | 139/383 A |
| 4,815,499 | 3/1989 | Johnson | 139/383 A |
| 4,821,780 | 4/1989 | Tate | 139/425 A X |

*Primary Examiner*—Andrew M. Falik

*Attorney, Agent, or Firm*—Beveridge, DeGrandi & Weilacher

[57] ABSTRACT

In a single-layer papermaking woven fabric of more than four shafts, auxiliary wefts each having a smaller diameter than that of the primary wefts are disposed between each of the primary wefts. Each of the auxiliary wefts is woven once into a repeating unit of a texture by a warp. Each auxiliary weft is placed by at least two other warps extending above two adjacent primary wefts. The auxiliary wefts are pushed or urged upwardly thereof by these at least two other warps in order to form a flat papermaking surface of the fabric, whereby wire marks on a paper are reduced.

6 Claims, 17 Drawing Sheets

SINGLE-LAYER PAPERMAKING FABRIC HAVING A FLAT SURFACE OF AUXILIARY WEFTS

BACKGROUND OF THE INVENTION

The present invention relates to papermaking fabric for use in the paper manufacture.

In the conventional papermaking process carried out by using a fourdrinier wire screen, a slurry of raw paper material is supplied onto a papermaking woven fabric or cloth running continuously in an endless manner. The papermaking cloth separates cellulosic fibers from the slurry to thereby form a moist paper web thereon. From this viewpoint, it can be said that the papermaking cloth functions as a filter in the process of forming the moist paper web. Mesh apertures of the fabric also referred to as the drain orifices serve for the function of separating water from the slurry. Further, in the case of a fourdrinier wire screen type papermaking machine, the papermaking fabric serves also as a driving belt and is thus subjected to a tension exerted by the machine. For this reason, it is required that the papermaking fabric should exhibit an enhanced runability.

Among the several requirements imposed on the papermaking process, the following are to be noted among others in connection with the papermaking cloth. Namely, the papermaking cloth is required to exhibit a high paper material retention, i.e. a minimum flow loss of the paper material, no generation of wire marks, a high drainage capability with a reduced water containing capacity, a high abrasion resistance capability, an enhanced runability and others.

With a view to satisfying the above requirements imposed on the papermaking woven fabric or cloth, there have heretofore been made a variety of proposals. However, at the present state of the art, there are yet unavailable the papermaking fabrics which satisfy the abovementioned requirements to the satisfactory extent.

By way of example, the papermaking cloth woven finely by using fine yarns in an effort to improve the paper material retention capability while preventing formation of the wire marks suffers from such shortcomings that the runability and the abrasion resistance capability are poor. In recent years, attempts have been made to form the papermaking surface of the fabric from the wefts to thereby improve the paper material retention capability. The papermaking surface formed from the wefts is certainly advantageous in that the cloth is improved in respect to the drainage property because of little or no possibility of the drain apertures existing between the warps being directly blocked by the paper material. In that case, it is however noted that the wire marks become more noticeable because the inter-weft gaps are increased correspondingly.

As an approach, it has already been proposed to increase the number of the wefts forming the papermaking surface of a double-weft woven fabric by disposing so-called floating yarns which are not ordinarily woven into the texture in the form of interweave with the warps and the wefts forming the cloth. This proposal is certainly an interesting technical concept from the standpoint of increasing the number of the wefts of the papermaking surface of the cloth, which concept cannot however be applied to practical papermaking process, because the wefts not woven into the texture, i.e. the floating yarns tend to be displaced and collected together under a hydraulic pressure applied thereto upon charging of the slurry on the papermaking cloth, resulting in that the papermaking surface cannot be maintained flat uniformly.

The problem of generation of the wire marks becomes more remarkable in the case of the single-layer woven fabric in which the wefts form projections on the papermaking surface.

There has also been proposed the use of a multi-layer woven fabric in an effort to realize a high drainage property and a papermaking surface of a fine mesh while ensuring a high abrasion resistance capability.

Recently, there arises also a trend that the papermaking process is carried out at a higher speed with a view to increasing the efficiency of papermaking process, which however presents additionally new problems. The multi-layer woven fabric which can certainly exhibit advantageous effects unattainable with the single-layer cloth has a high water containing property which is primarily ascribable to a large volume of voids. Consequently, there will take place at a high rotational speed such phenomenon that water contained in the cloth is caused to spill out at the locations of the rotating turn-back rolls under a centrifugal force.

In this conjunction, it is noted that the single-layer woven fabric is substantially insusceptible to the phenomenon mentioned above due to inherently small water retaining capacity. However, the single-layer woven fabric is disadvantageous in that the wire marks are likely to be generated, the paper material retaining capability is poor and that the yield of the papermaking is not to be satisfied, as described hereinabove.

In the course of intensive studies conducted by the inventor of the present application in tackling the solution of the problems associated with the requirements for a high paper material capability, suppression of generation of the wire marks, a high water drainage capability with a low water containing capacity, a high abrasion resistance capability and an improved runability and others, it has been found that an increased density of the wefts in the papermaking surface of fabric is not suited for enhancing the raw paper material retention capability, while the multi-layer woven fabric is subjected to a limitation in reducing the water containing capacity of the fabric, requiring thus the use of the single-layer woven fabric. On the basis of this recognition, the inventors have reached the present invention.

SUMMARY OF THE INVENTION

In view of the state of the art described above, the present invention provides:

A single-layer papermaking woven fabric of more than four shafts inclusive thereof having an extended running surface formed from long crimped wefts, wherein auxiliary wefts each having a smaller diameter than that of the weft are each disposed in juxtaposition with each of the wefts, each of the auxiliary wefts being woven once into texture by a warp to thereby form a unity texture, wherein the auxiliary wefts are pushed or urged upwardly at two or more portions thereof by the warps to thereby form a flat surface of the auxiliary wefts on the papermaking surface.

In accordance with one aspect of the invention, one auxiliary weft is disposed for each of the wefts.

In accordance with another aspect of the invention, a plurality of the auxiliary wefts are disposed for each of the wefts.

In the single-layer woven fabrics according to the invention, each auxiliary weft is positioned on at least two warps extending above the two adjacent wefts and is woven into texture by the warp once in one unity texture, whereby substantially horizontal long knuckles straddling over at least two warps are formed in the papermaking surface. Thus, the woven fabric for the papermaking according to the present invention is characterized in that the papermaking surface is formed of the knuckles of the thin auxiliary wefts and the intrinsic wefts.

Since each auxiliary weft is woven into the texture of the fabric once in each unity texture, there are formed a number of knuckles of the auxiliary wefts in the papermaking surface of the fabric. The woven fabric according to the invention may be made from polyamide yarns or polyester yarns. The auxiliary wefts should preferably be made of polyester or polyamide yarns. At least one auxiliary weft is disposed in juxtaposition with each of the intrinsic wefts. In this connection, it should be mentioned that more than two auxiliary wefts inclusive thereof may be disposed so far as the single-layer structure of the woven fabric can be maintained, as will be described in more detail later on in conjunction with FIG. 27.

As the basic texture or structure of the woven fabric in which the auxiliary wefts are incorporated according to the teaching of the present invention, there may be mentioned 3/1 broken satin weave, 4/1 satin weave, 3/1 to 4/1 twill weaves, 2/2 twill weave and the like. In the case of the 2/1 twill woven fabric, the invention can equally be applied to a 6-shaft textile as well.

Since the woven fabric according to the invention is of more than four shafts inclusive thereof, the wefts forming the running surface form the long crimps to thereby improve the abrasion resistance capability, to further advantage.

Because the shaft number of the woven fabric according to the present invention is not smaller than four, the auxiliary weft is pressed or urged upwardly by the warps at two or more locations in the unity texture, a flat surface of the auxiliary wefts can be formed on the papermaking surface.

It is apparent that the inventive papermaking cloth of the structure described above is provided with the papermaking surface enriched in the wefts inclusive of the auxiliary wefts disposed between the intrinsic wefts. Further, distribution of the auxiliary wefts is uniform because of the disposition thereof in juxtaposition with the intrinsic weft.

When the fabric is observed in a section taken along a warp, it can be seen that every auxiliary weft is disposed on the warps between the weft knuckles forming projections in the papermaking surface of the fabric to thereby realize a smooth papermaking surface having substantially no roughness due to the weft knuckles.

On the other hand, when viewed in a section taken along an auxiliary weft, it can be seen that the auxiliary wefts form long knuckles each straddling over at least two warps on the papermaking surface. Structures of the woven fabric will hereinafter be described in more detail in conjunction with exemplary embodiments of the invention by reference to the accompanying drawings.

One of the important features of the present invention resides in that the auxiliary weft is woven at least once into the fabric in each unity texture. By virtue of this feature, the auxiliary wefts constitute integral parts of the fabric texture and impart rigidity to the fabric to thereby enhance the runability of the fabric, to great advantage.

Another important feature of the invention is seen in the fact that the woven fabric is formed in the single-layer structure with voids as well as the water containing capacity being decreased, whereby such phenomenon that water droplets are caused to spill out from the fabric in the course of high-speed paper manufacture can be avoided, while the structural problem of generation of the wire marks due to projections of the wefts in the papermaking surface can also be solved satisfactorily. Thus, the paper is imparted with enhanced smoothness, while drainage apertures of a size sufficient to improve the drainage can be assured. Additionally, an increased density of the wefts on the papermaking surface of the woven fabric contributes to improvement of the fabric with regard to the paper material retention property. The auxiliary weft employed according to the teaching of the present invention is required to have a smaller diameter than that of the inherent weft. Assuming that the thick auxiliary weft is employed, the voids for drainage will be blocked by them to be correspondingly decreased. However, by using the thin auxiliary weft, the voids for drainage of the papermaking surface can be maintained satisfactorily.

Figure 1:
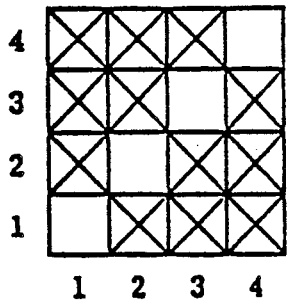
FIG. 1, FIG. 5, FIG. 9, FIG. 12, FIG. 19 and FIG. 22 show, as prior art respectively, textile design charts of basic units forming papermaking fabrics to which the invention is applied, FIGS. 2A, 3 and to 4, FIGS. 6A, 7 and to 8, FIG. 10A, FIG. 11, FIG. 13A, FIGS. 14 to 17, FIG. 18A, FIG. 20A, FIG. 21, FIGS. 23A, 24 to 26 and FIG. 27 A show, respectively, unity textile design charts for illustrating exemplary embodiments of the present invention.

It should be noted that in FIGS. 2C, 6C, 10C, 13C, 18C, 20C and 27C, sectional views of two continuing repeating units of papermaking fabrics are shown respectively.

In the drawings, Arabic numeral denotes warps and wefts, Arabic numerals with prime "′" denote auxiliary wefts, symbols "X" denote locations where warps are positioned on the wefts, and symbol "Δ" denote locations where wefts are pushed upwardly by warps. Further, blank boxes having no mark "X" or " " denote locations where wefts are positioned on the warps and are not strongly pushed upwardly by warps.

DESCRIPTION OF PREFERRED EMBODIMENTS OF THE INVENTION

In the following, exemplary or preferred embodiments of the present invention will be described in more detail by referring to the accompanying drawings which show in textile design charts unity textures or structures of woven fabrics. For convenience of explanation, typical prior art structures of basic textile of four to eight shafts in which the auxiliary wefts are incorporated will be described by referring to FIG. 1, FIG. 5, FIG. 9, FIG. 12, FIG. 19 an FIG. 22. It should however be understood that the present invention can also be applied to the woven fabrics of other than the above-mentioned shaft numbers. In other words, the present invention can fine its application equally to the papermaking cloth or fabric of ten shafts, as will be made apparent in conjunction with the description of the embodiments shown in FIGS. 25 and 26.

In each of the textile design charts, the warps and the inherent wefts are designated by Arabic numerals such as, for example, 1, 2, 3 and so forth, while the auxiliary wefts are denoted by Arabic numerals attached with prime "′" such as, for example, 1′, 2′, 3′, etc.

Now, referring to the drawings, FIG. 1 shows a texture of 4-shaft 3/1 twill woven fabric as prior art.

Figure 2A:
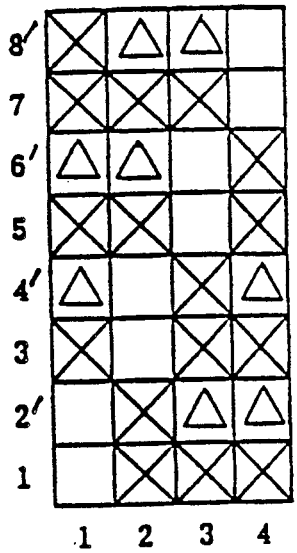
PRIOR ART Fig. 2A
FIG. 2B, FIG. 6B ,FIG. 10B, FIG. 13B, FIG. 18B, FIG. 20B, FIG. 23B and FIG. 27B shown plan views of basic textures of papermaking fabric respectively shown in FIG. 2A, FIG. 6A, FIG. 10A, FIG. 13A, FIG. 18A, FIG. 20A, FIG. 23A and FIG. 27A as repeating unit textile design charts.
FIG. 2C shows a cross-sectional view of the papermaking fabric taken along the line II–II' in FIG. 2B.
Figure 2B:
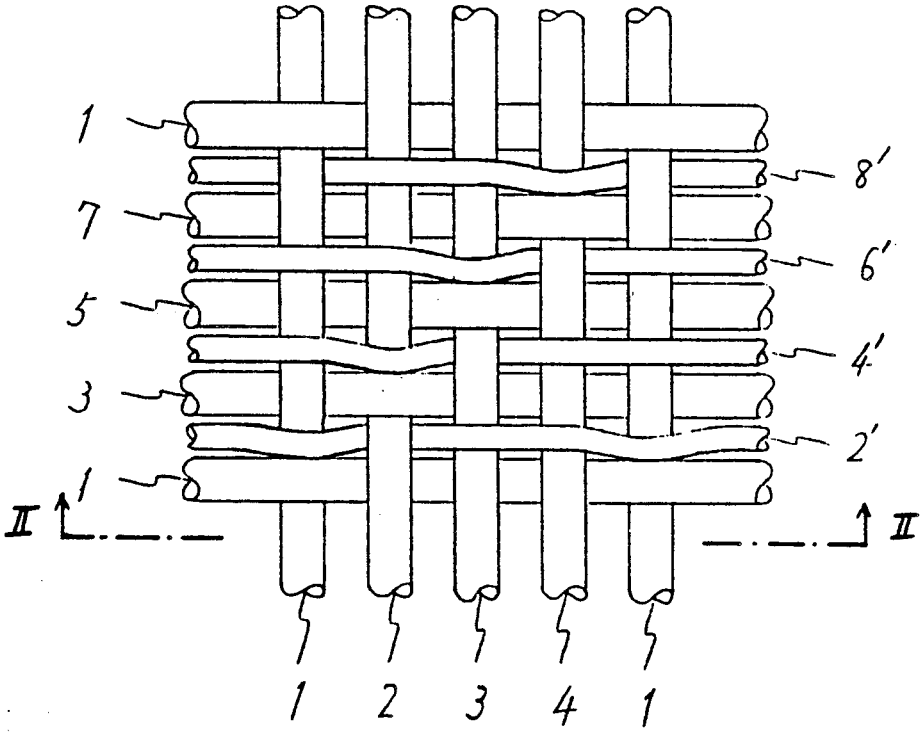
Figure 2C:
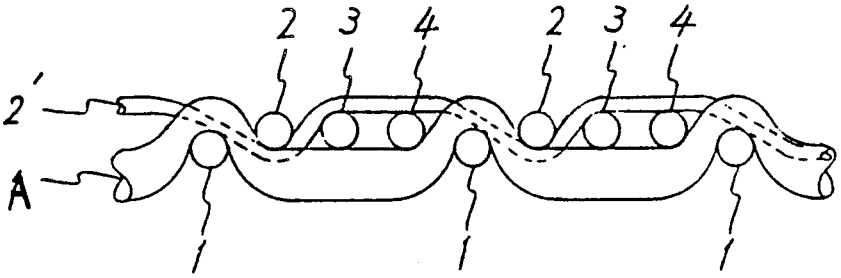

FIGS. 2A through 2C shows a woven fabric according to an embodiment of the present invention which is constituted by 4-shaft 3/1 twill woven fabric in which the auxiliary wefts 2′, 4′, 6′ and 8′ are disposed one by one in juxtaposition with intrinsic wefts 1, 2, 3 and 4, respectively, in the woven fabric of the texture shown in FIG. 1. Considering the auxiliary weft 2′, by way of example, this auxiliary weft 2′ is woven once into the texture by the warp 2 and pushed or urged upwardly at two locations by the warps 3 and 4. In this manner, the auxiliary weft 2′ disposed on at least two warps 3 and 4 extending above the two adjacent wefts 1 and 3 is urged upwardly by the warps at least at two locations to be thereby positions on the warps 1, 3 and 4 without sinking, whereby a flat surface is formed. In other words, the papermaking surface is realized flat by the knuckles of the auxiliary wefts and the intrinsic wefts with generation of the wire marks being suppressed. Parenthetically, in FIG. 2, the wefts 1 to 4 shown in FIG. 1 are denoted by 1, 3, 5 and 7 without the prime "′".

Figure 3:
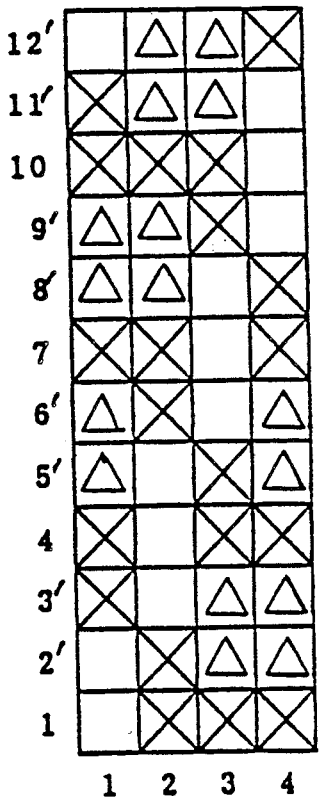

FIG. 3 shows another embodiment of the present invention according to which two auxiliary wefts are disposed in juxtaposition with each weft of the woven fabric shown in FIG. 1. The paired auxiliary wefts are denoted by 2′; 3′, 5′; 6′, 8′; 9′and 11′; 12′, respectively. Considering by taking as example the auxiliary wefts 5′ and 6′, the auxiliary weft 5′ is woven once into the texture by the warp 3, urged upwardly by the warps 1 and 4 at two locations and disposed on the warps 1, 2 and 4 to form a flat surface area. On the other hand, the auxiliary weft 6′ is woven once into the texture by the warp 2, pushed upwardly by the warps 1 and 4 at two locations and disposed on the warps 1, 3 and 4 to thereby form a flat surface area.

Figure 4:
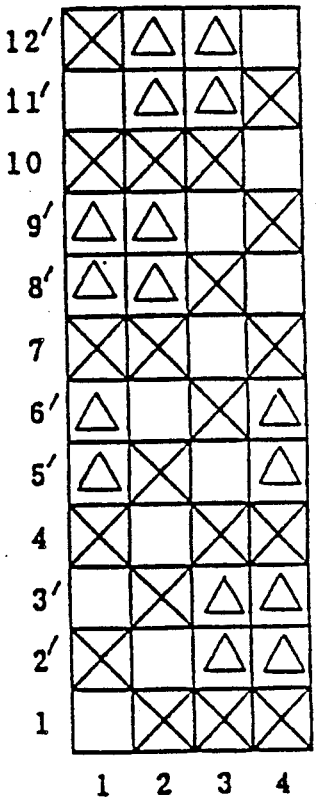

FIG. 4 shows another embodiment of the present invention in which a pair of the auxiliary wefts are disposed in juxtaposition with each weft, as in the case of the embodiment shown in FIG. 3, but differs from the latter in respect to the positions where the auxiliary wefts are woven in the texture. By way of example, the auxiliary weft 5′ is woven once into the texture by the warp 2, urged or pushed upwardly by the warps 1 and 4 at two locations and disposed on the warps 1, 3 and 4 to form a flat surface area. In other words, although the auxiliary weft 5′ is woven into the texture by the warp 3 in the case of the embodiment illustrated in FIG. 3, the auxiliary weft 5′ is woven into the texture by the warp 2 in the case of the embodiment shown in FIG. 4.

Figure 5:
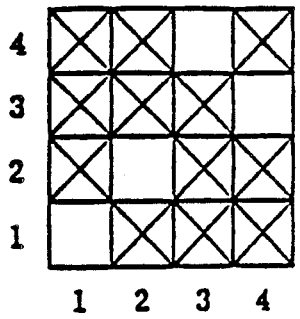

FIG. 5 shows a texture of 4-shaft 3/1 broken twill woven fabric as prior art.

Figure 6A:
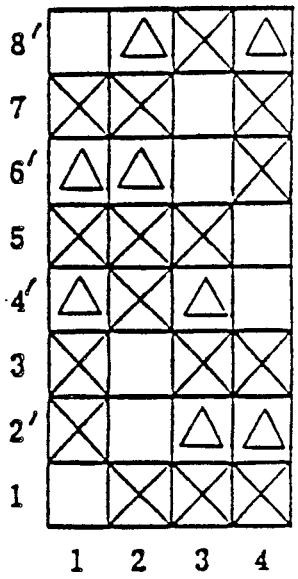
PRIOR ART Fig. 6A
FIG. 6C shows a cross-section view of the papermaking fabric taken along the line VI–VI' in FIG. 6B.
Figure 6B:
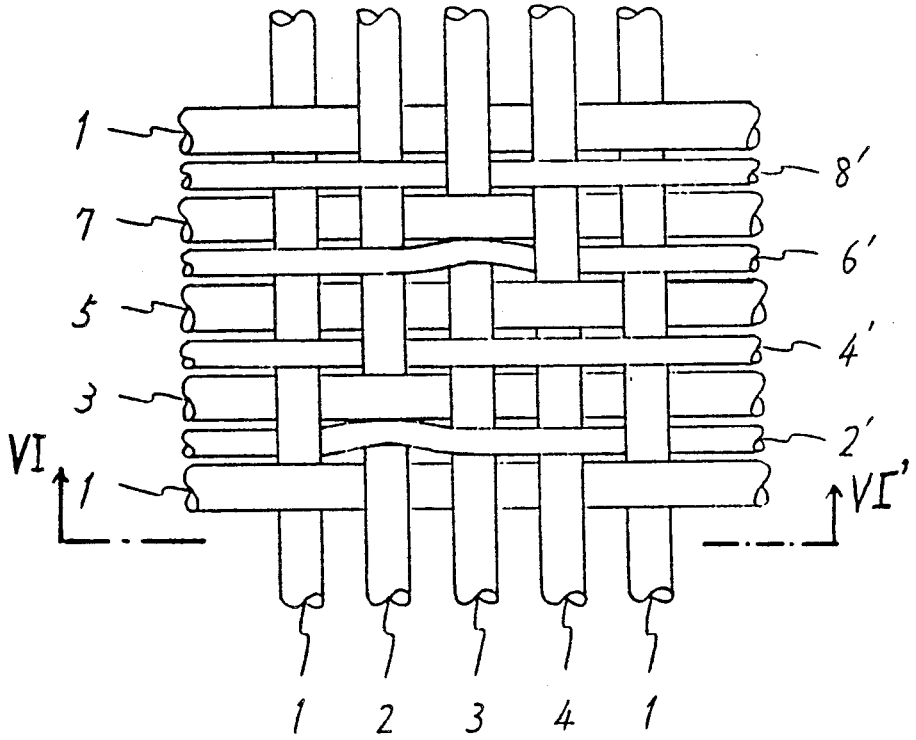
Figure 6C:
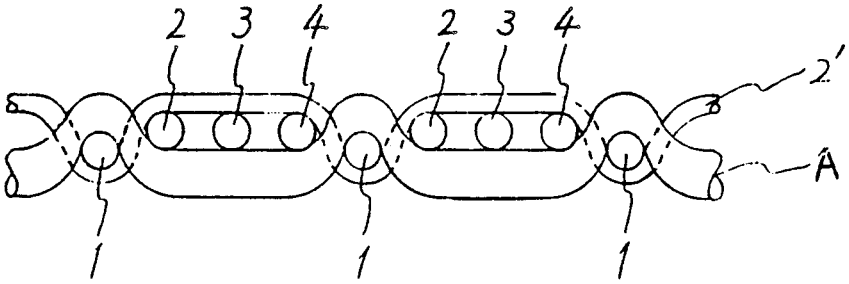

FIGS. 6A through 6C shows a further embodiment of the present invention according to which the auxiliary wefts 2′, 4′, 6′ and 8′ are disposed on by one in juxtaposition with the wefts 1, 2, 3 and 4, respectively, in the woven fabric of the texture shown in FIG. 5. The auxiliary wefts are denoted by the reference numerals 2′, 4′, 6′ and 8′. In the exemplary embodiment shown in FIG. 6, the auxiliary weft 4′, by way of example, is woven once into the texture by the warp 2, pushed upwardly by the warps 1 and 3 and disposed on the warps 1, 3 and 4 to thereby form a flat surface region.

Figure 7:
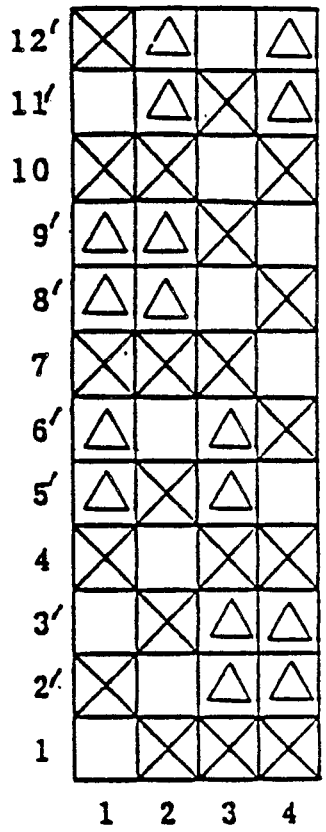
Figure 8:
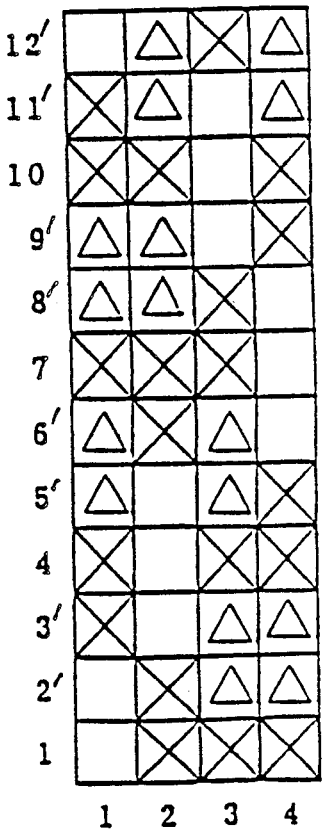

FIGS. 7 and 8 show, respectively, further exemplary embodiments of the present invention in both of which pairs of the auxiliary wefts 2′; 3′; 5′; 6′, 8′; 9′ and 11′; 12′ are disposed in juxtaposition with the wefts 1, 2, 3 and 4, respectively, of the texture shown in FIG. 5 and which differ from each other in respect to the position where the auxiliary weft is woven into the texture. Referring to FIG. 7, the auxiliary weft 5′ is woven into the texture by the warp 2, pushed upwardly by the warps 1 and 3 at two locations and disposed on the warps 1, 3 and 4 to form a flat surface region. On the other hand, in the case of the embodiment shown in FIG. 8, the auxiliary weft 5′ is woven into the texture by the warp 4, pushed upwardly by the warps 1 and 3 at two locations and disposed on the warps 1, 2 and 3 to form a flat surface area.

Figure 9:
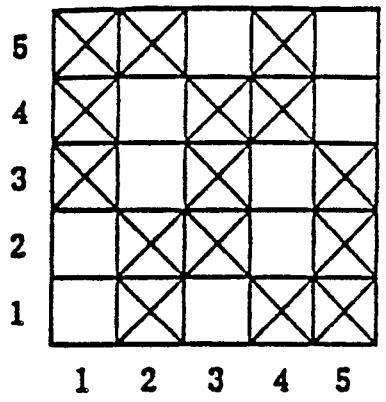

FIG. 9 is a unity design chart showing a texture of 5-shaft 3/2 broken twill woven fabric as prior art.

Figure 10A:
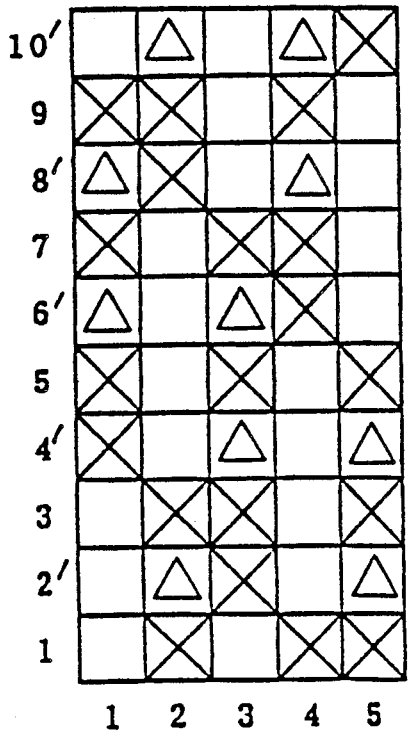
PRIOR ART Fig. 10A
FIG. 10C shows a cross-sectional view of the papermaking fabric taken along the line X–X' in FIG. 10B.
Figure 10B:
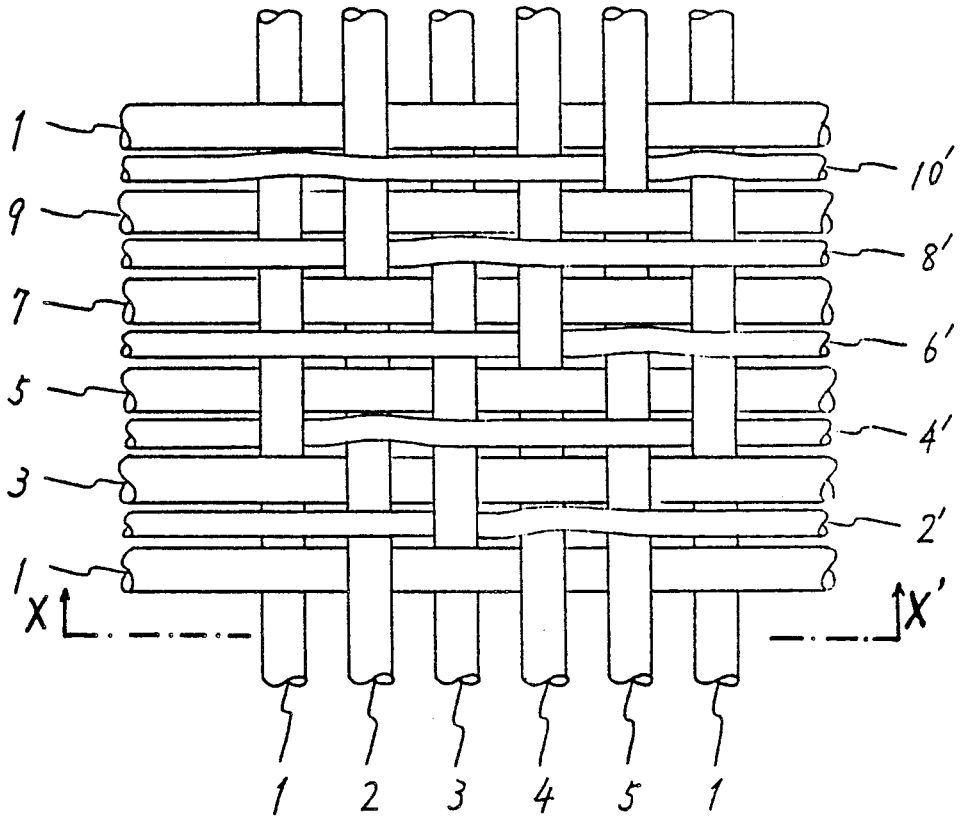
Figure 10C:
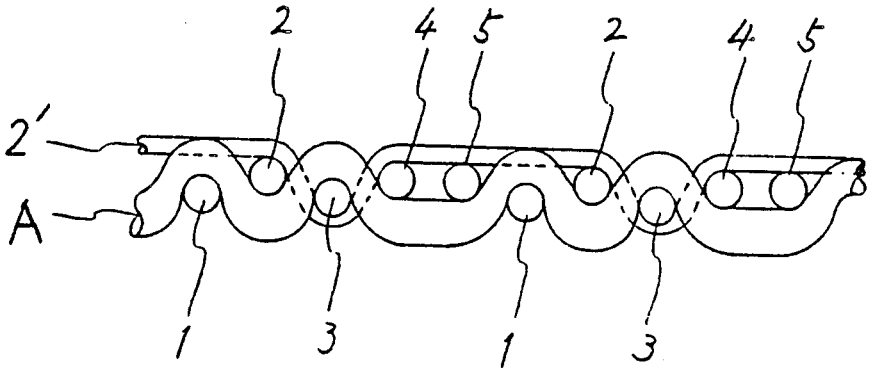

FIGS. 10A through 10C and 11 show, respectively, still further exemplary embodiments of the present invention in which the auxiliary weft(s) is/are disposed in juxtaposition with each of the intrinsic weft of the textile shown in FIG. 9. Referring to FIGS. 10A through 10C, the auxiliary wefts 1′, 4′, 6′, 8′ and 10′ are each disposed in juxtaposition with the wefts 1, 2, 3, 4 and 5, respectively, of the texture shown in FIG. 9. Considering the auxiliary weft 2′, this is woven into the texture by the warp 3, pushed upwardly by the warps 2 and 5 and disposed on the warps 1, 2, 4 and 5 to form a flat surface area.

Figure 11:
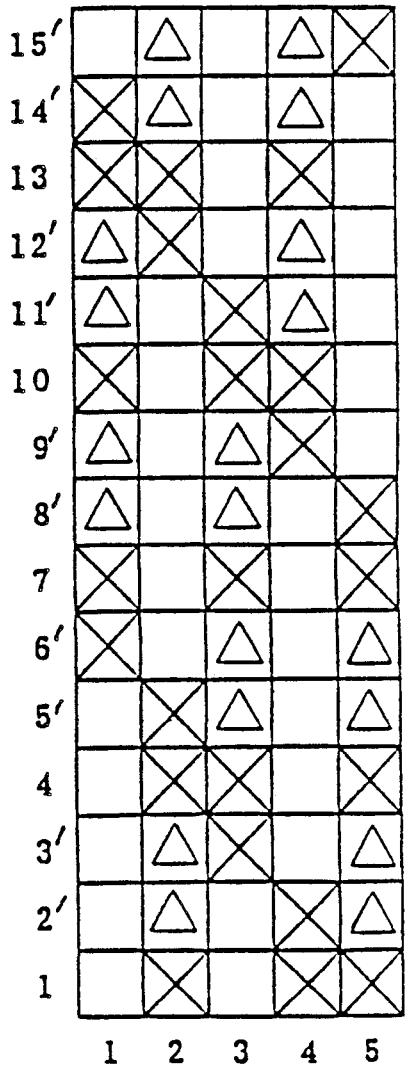

Referring to FIG. 11, pairs of the auxiliary wefts 2′; 3′, 5′; 6′, 8′; 9′, 11′; 12′ and 14′; 15′ are each disposed in juxtaposition with the wefts 1, 2, 3, 4 and 5, respectively, in the texture shown in FIG. 9. Considering the auxiliary weft 2′, this weft is woven into the texture by the warp 4, urged upwardly by the warps 2 and 5 and disposed on the warps 1, 2, 3 and 5 to form a flat surface area.

Figure 12:
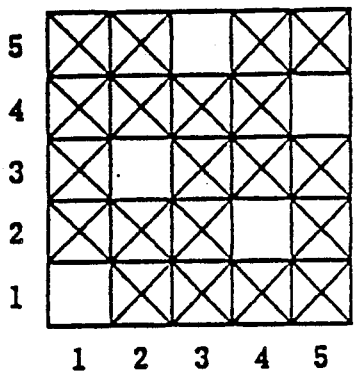

FIG. 12 is a design chart showing a texture of 5-shaft 4/1 satin woven fabric as prior art.

Figure 13A:
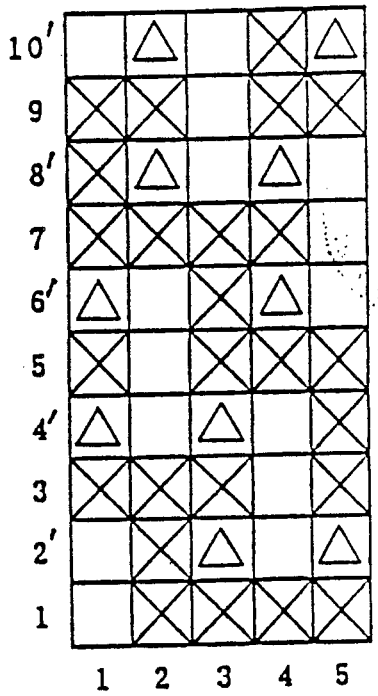
PRIOR ART Fig. 13A
FIG. 13C shows a cross-sectional view of the papermaking fabric taken along the line XIII–XIII' in FIG. 13B.
Figure 14:
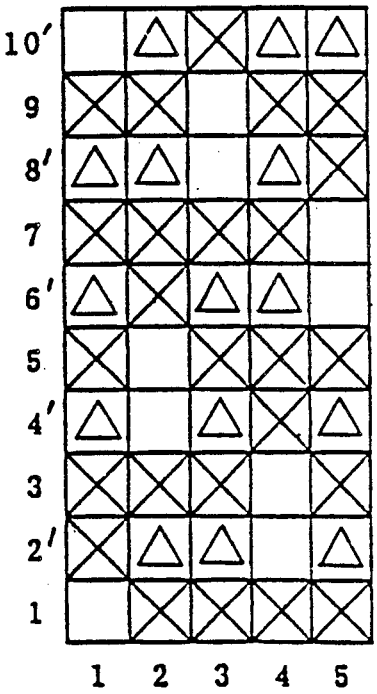
Figure 15:
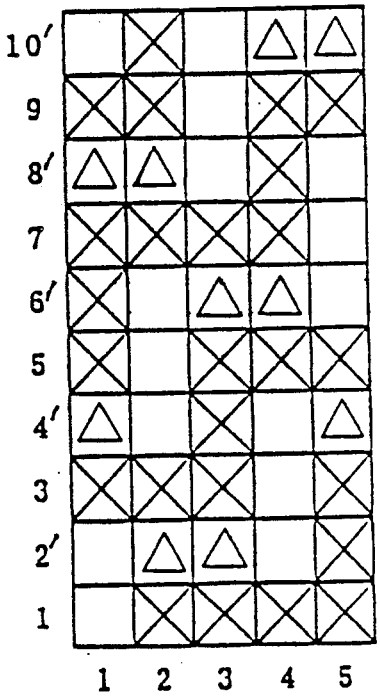
Figure 16:
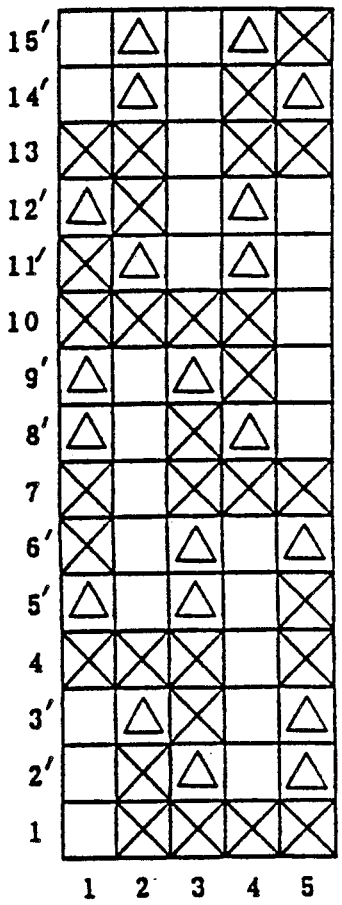

FIGS. 13A, 14 and 15 show, respectively, further exemplary embodiments of the present invention in which the auxiliary wefts are disposed in juxtaposition with the intrinsic wefts, respectively, in the fabric of the texture shown in FIG. 12, while FIGS. 16 and 18 show exemplary embodiments in which pairs of the auxiliary wefts are disposed in juxtaposition with the individual wefts, respectively, in the fabric of the texture shown in FIG. 12.

Figure 13B:
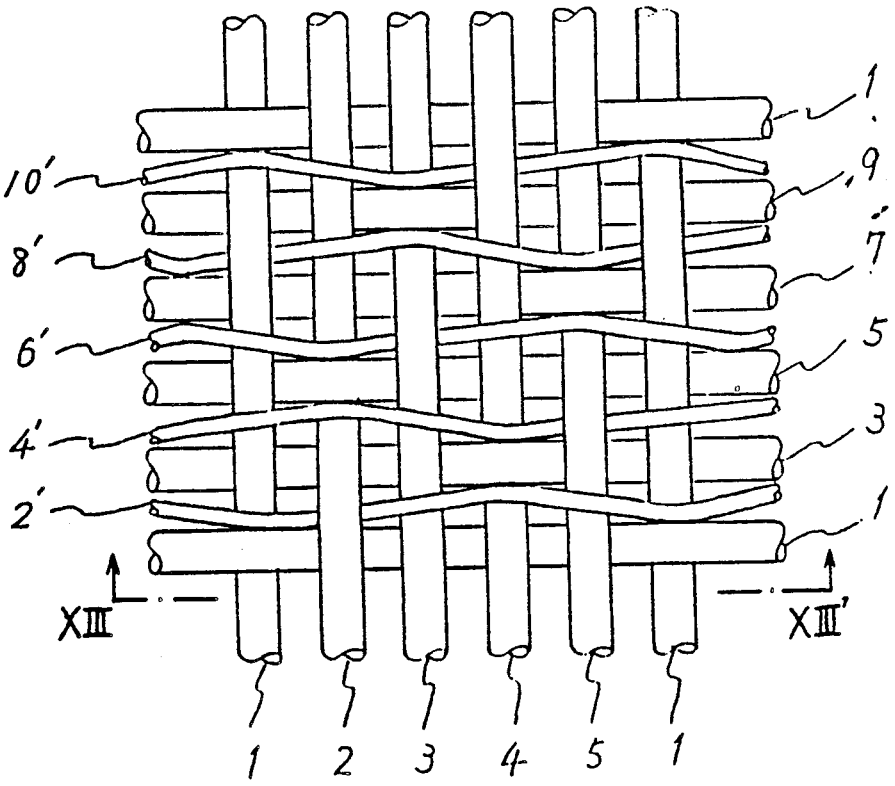
Figure 13C:
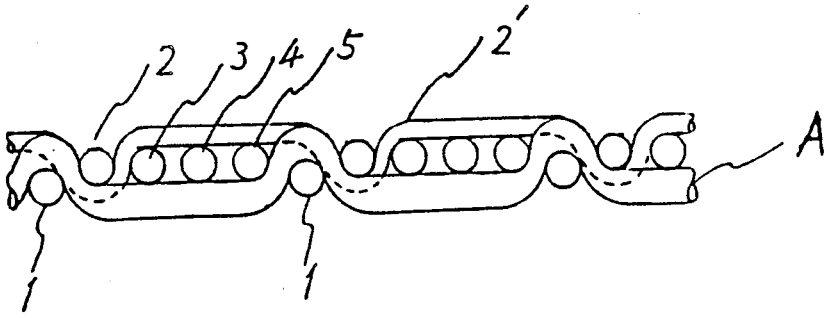

Referring to FIG. 13A through 13C, the auxiliary weft 2' is woven into the texture by the warp 2, pushed upwardly by the warps 3 and 5 at two locations and disposed on the warps 1, 3, 4 and 5 to form a flat surface area.

In the case of the embodiment shown in FIG. 14, the auxiliary weft 2' is woven into the texture by the warp 1, pushed upwardly by the warps 2, 3 and 5 and disposed on the warps 2, 3, 4 and 5 to form a flat surface area. In this manner, it is preferred that as the shaft number is increased, the number of the locations of the auxiliary weft where the latter is pushed or urged upwardly be increased correspondingly to thereby prevent the auxiliary weft from sinking upon forming the papermaking surface.

The embodiment shown in FIG. 15 differs from the one shown in FIG. 13 in respect to the position where the auxiliary weft is woven into the texture and where the auxiliary weft is urged or pressed upwardly. Referring to FIG. 15, the auxiliary weft 2' is woven into the texture by the warp 5, pushed upwardly by the warps 2 and 3 and disposed on the warps 1, 2, 3 and 4 to form a flat surface area.

In the woven fabric shown in FIG. 16, pairs of the auxiliary wefts are disposed in juxtaposition with the intrinsic wefts, respectively, in the fabric of the texture shown in FIG. 12. Referring to FIG. 16, the auxiliary weft 2' is woven into the texture by the warp 2, urged upwardly by the warps 3 and 5 at two locations and disposed on the warps 1, 3, 4 and 5 to form a flat surface region.

Figure 17:
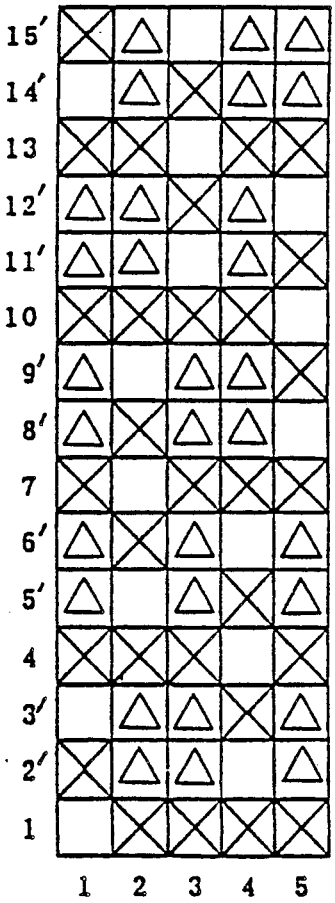

According to the embodiment shown in FIG. 17, pairs of the auxiliary wefts 2'; 3', 5'; 6', 8'; 9', 11'; 12' and 14'; 15' are disposed in juxtaposition with the wefts 1, 2, 3, 4 and 5, respectively, in the fabric of the texture shown in FIG. 12, and each of auxiliary wefts is woven once into the unity texture by the warps, and pushed upwardly at three locations, respectively. More specifically, the auxiliary weft 2', for example, is woven into the texture by the warp 1, pushed upwardly by the warps 2, 3 and 5 at three locations and disposed on the warps 2, 3, 4 and 5 to form a flat surface area.

Figure 18A:
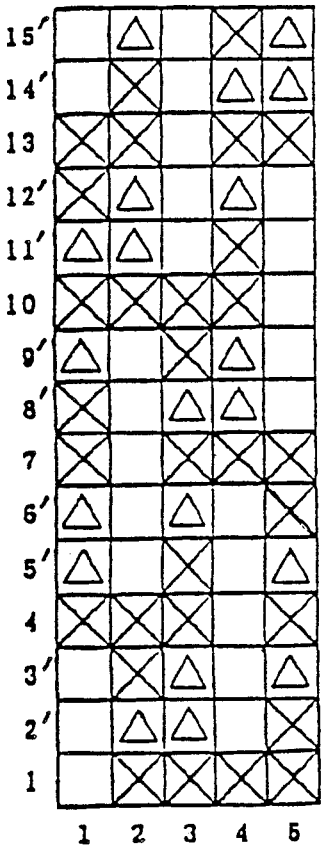
FIG. 18C shows a cross-sectional view of the papermaking fabric taken along the line XVIII–XVIII' in FIG. 18B.
Figure 18B:
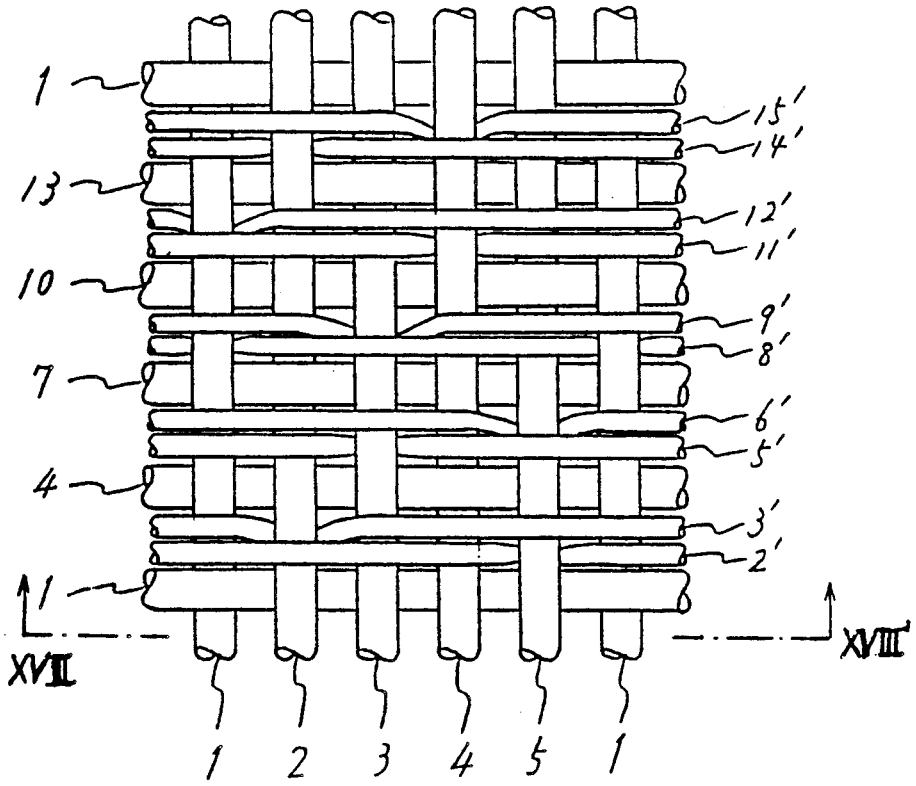
Figure 18C:
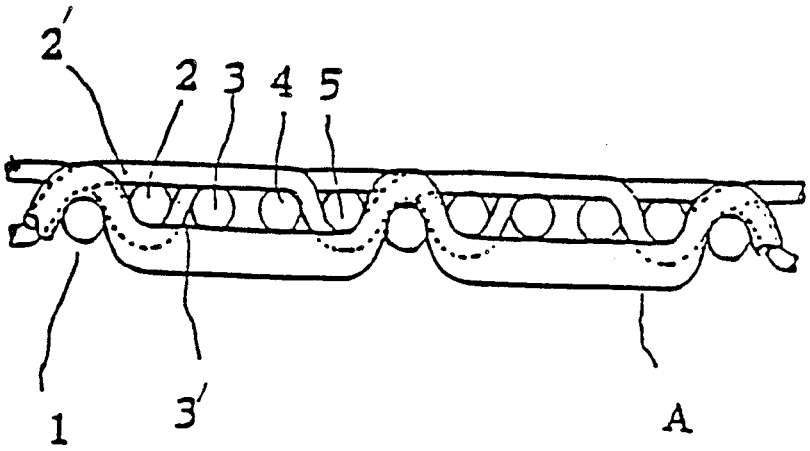

In the case of the fabric shown in FIGS. 18A through 18C, pairs of the auxiliary wefts are disposed, respectively, in juxtaposition with the wefts of the texture shown in FIG. 12. Referring to FIG. 18, the auxiliary weft 2', for example, is woven once into the unity texture by the warp 5, pushed or urged upwardly by the warps 2 and 3 at two locations and disposed on the warps 1, 2, 3 and 4 to form a flat surface region.

Figure 19:
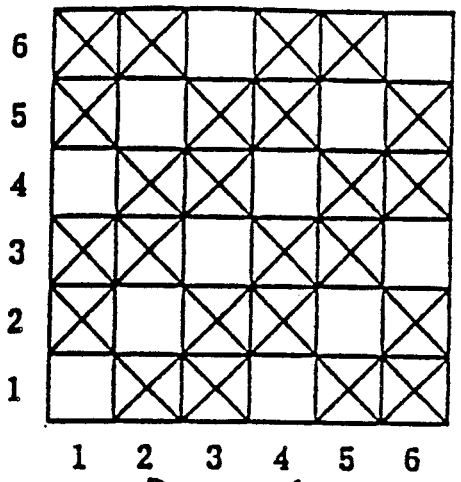

FIG. 19 is a design chart showing a unity texture of 6-shaft 2/1 twill woven fabric as prior art.

Figure 20A:
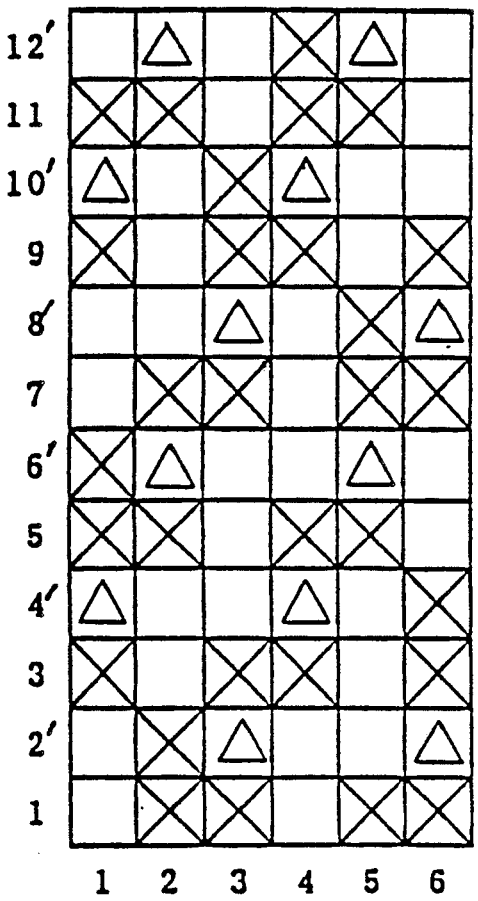
PRIOR ART Fig. 20A
FIG. 20C shows a cross-sectional view of the papermaking fabric taken along the line XX–XX' in FIG. 20B.
Figure 20B:
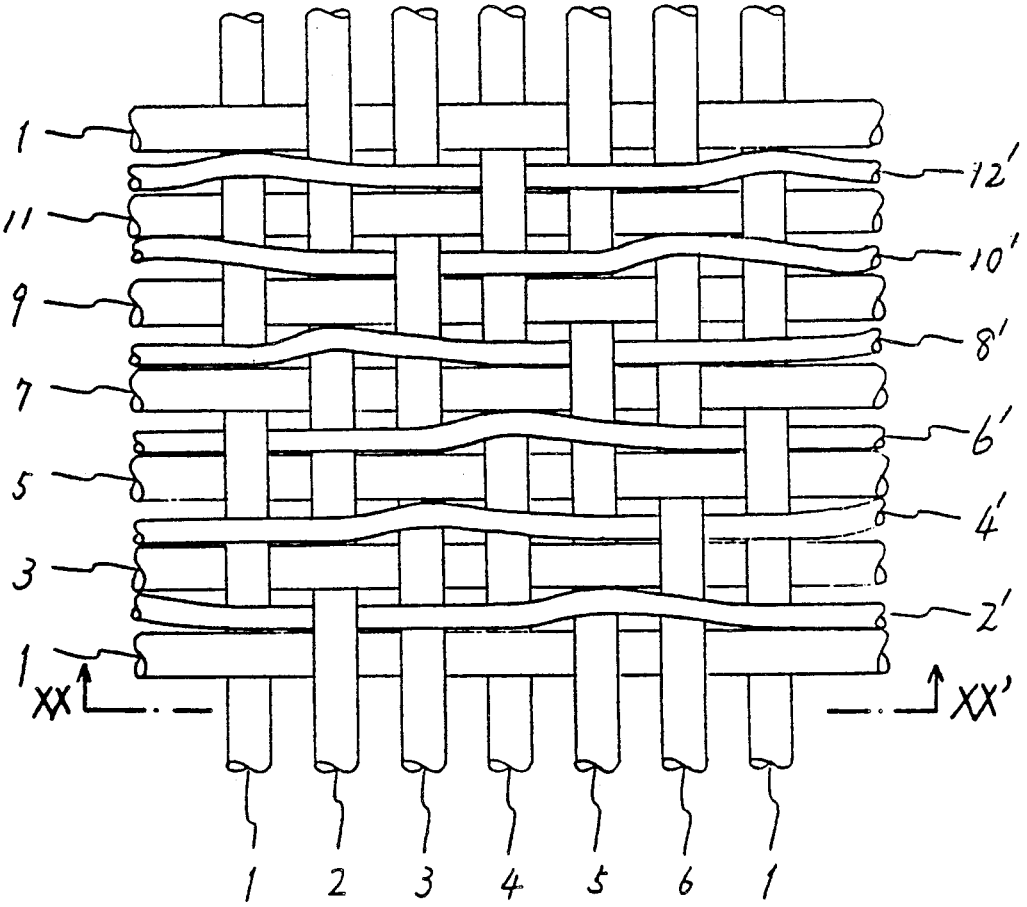
Figure 20C:
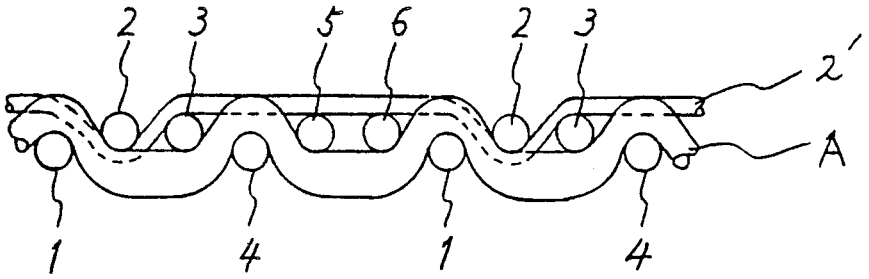

FIG. 20A through 20C shows a still further embodiment of the present invention in which the auxiliary wefts are disposed one by one in juxtaposition with the intrinsic wefts, respectively, of the fabric having the texture shown in FIG. 19. Referring to FIG. 20, the auxiliary wefts 2', for example, is woven once into the unity texture by the warp 2, pushed upwardly by the warps 3 and 6 at two locations and disposed on the warps 1, 3, 4, 5 and 6 to form a flat surface area.

Figure 21:
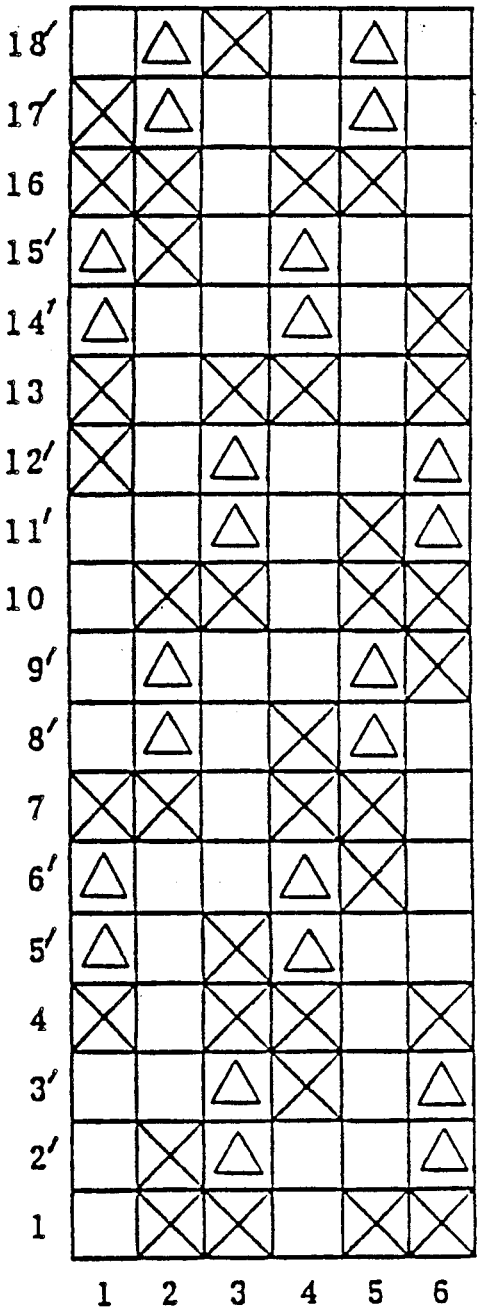

FIG. 21 shows a further embodiment of the present invention in which pairs of the auxiliary wefts are disposed in juxtaposition with each of the intrinsic wefts, respectively, of the fabric having the texture shown in FIG. 19. Referring to FIG. 21, the auxiliary wefts 2', for example, is woven into the texture by the warp 2, pushed upwardly by the warps 3 and 6 and disposed on the warps 1, 3, 4, 5 and 6 to form a flat surface region. On the other hand, the auxiliary weft 3' is woven into the texture by the warp 4, pushed upwardly by the warps 3 and 6 and disposed on the warps 1, 2, 3, 5 and 6 to thereby form a flat surface area.

Figure 22:
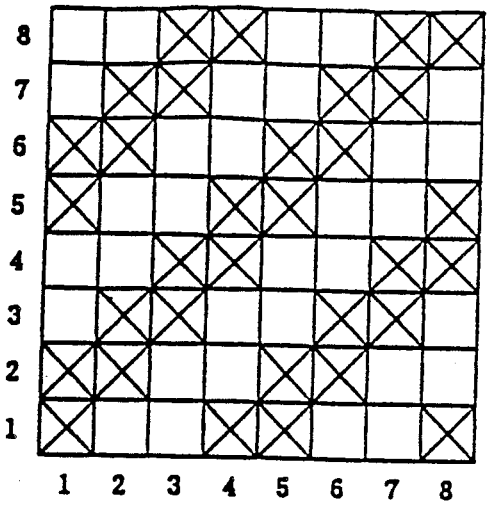

FIG. 22 is a design chart showing a texture of 8-shaft 2/2 twill woven fabric as prior art.

Figure 23A:
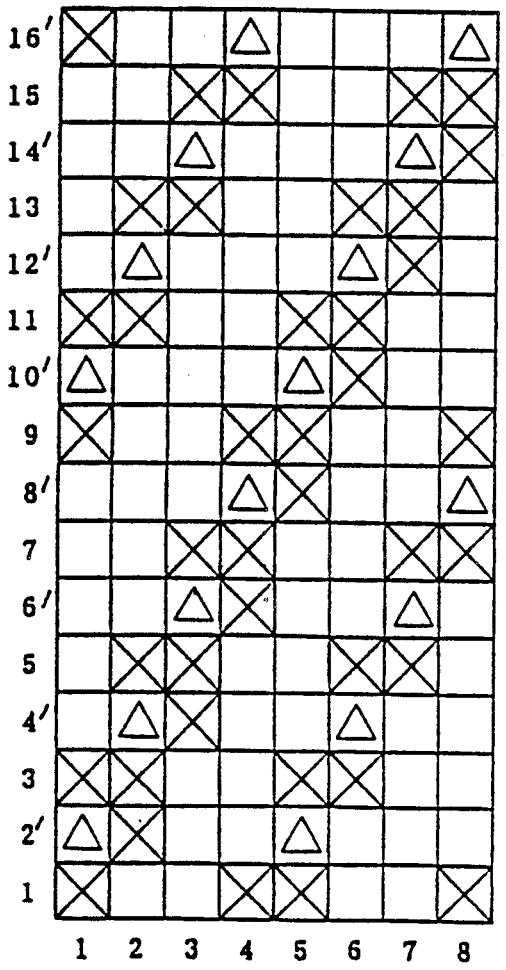
PRIOR ART Fig. 23A
FIG. 23C shows a cross-sectional view of the papermaking fabric taken along the line XXIII–XXIII' in FIG. 23B.
Figure 23B:
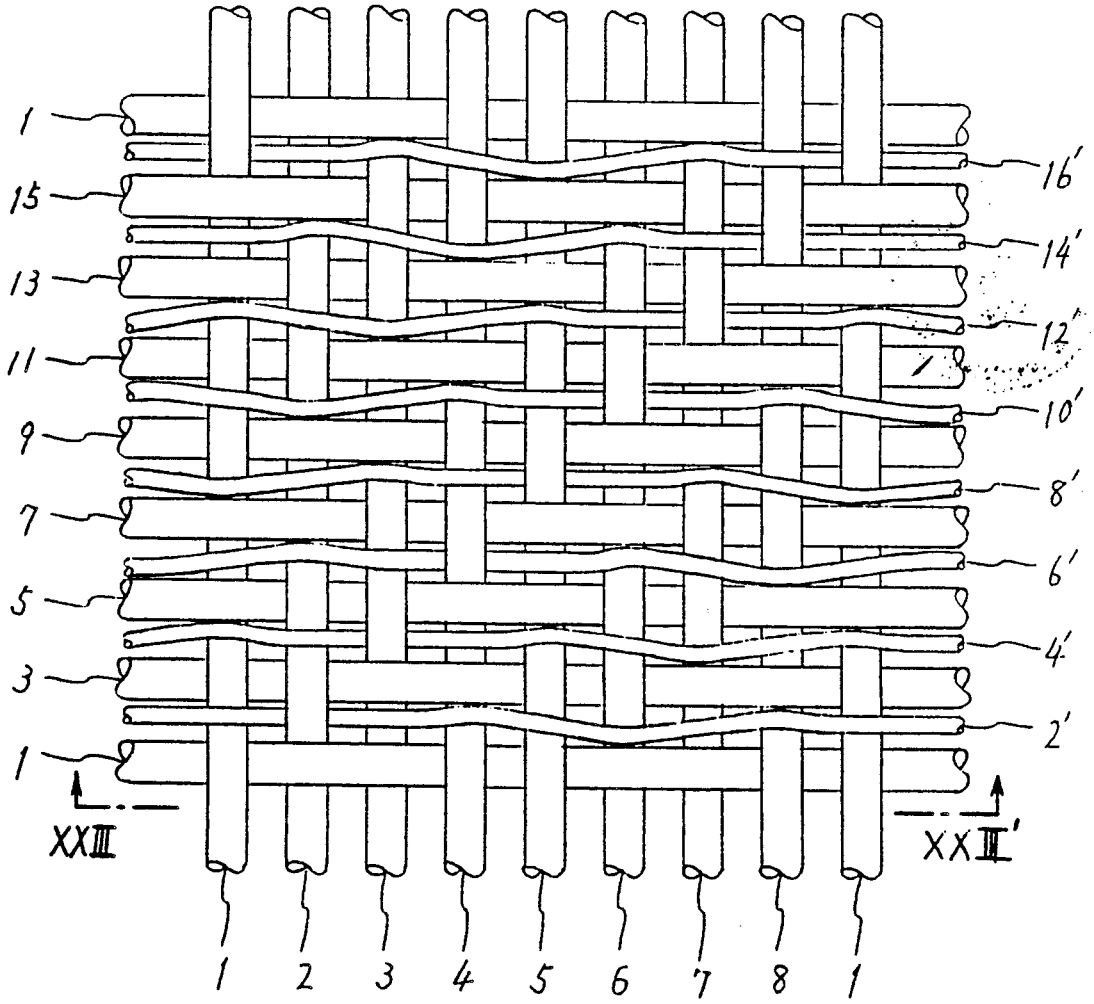
Figure 23C:
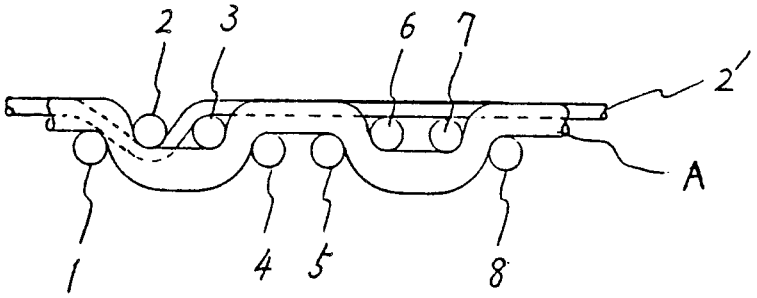

FIGS. 23A through 23C shows a still further embodiment of the present invention in which the auxiliary wefts are disposed one by one in juxtaposition with the intrinsic wefts, respectively, of the woven fabric shown in FIG. 22. Referring to FIG. 22, the auxiliary wefts 2', for example, is woven into the texture by the warp 2, pushed upwardly by the warps 1 and 5 at two locations and disposed on the warps 1, 3, 4, 5, 6, 7 and 8 to form a flat surface area.

Figure 24:
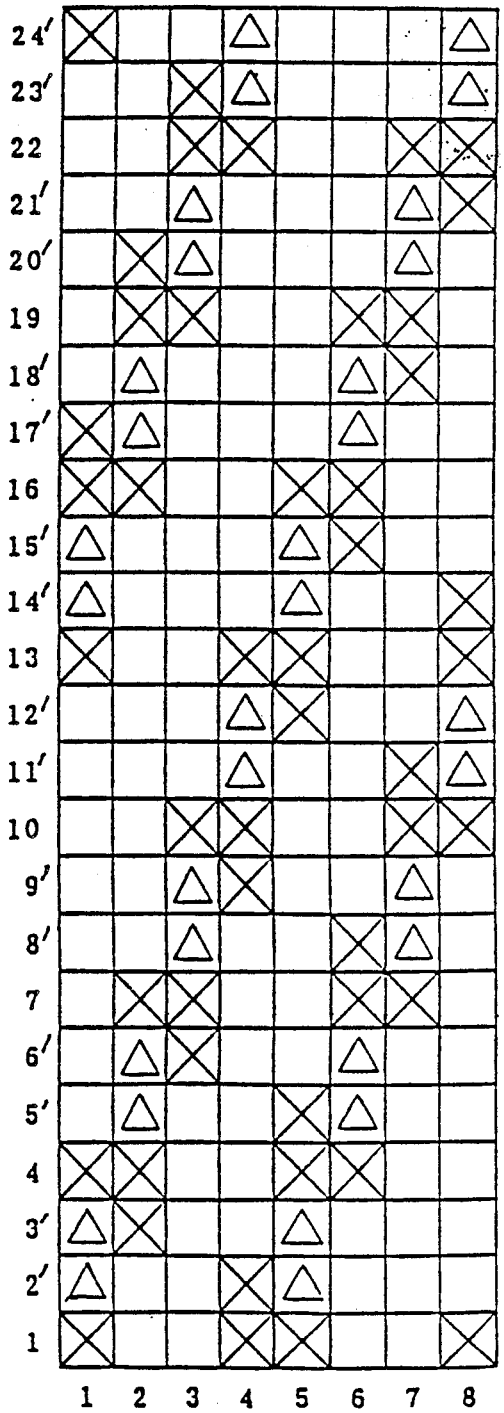

FIG. 24 shows yet another embodiment of the present invention in which pairs of the auxiliary wefts are disposed, respectively, in juxtaposition with the intrinsic wefts of the textile shown in FIG. 22. Referring to FIG. 24, the auxiliary wefts 2', for example, is woven into the texture by the warp 4, pushed upwardly by the warps 1 and 5 at two locations and disposed on the warps 1, 2, 3, 5, 6, 7 and 8 to form a flat surface region. On the other hand, the auxiliary weft 3' is woven into the texture by the warp 2, pushed upwardly by the warps 1 and 5 at two locations and disposed on the warps 1, 3, 4, 5, 6, 7 and 8 to thereby form a flat surface area.

Figure 26:
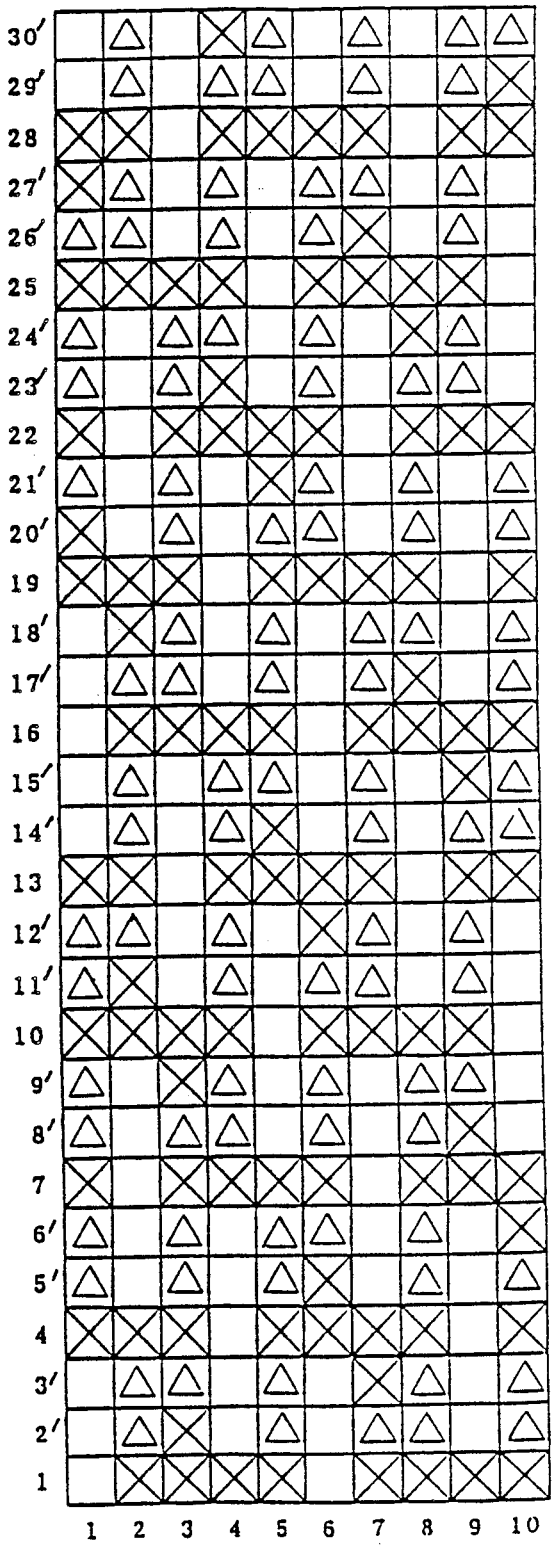
Figure 25:
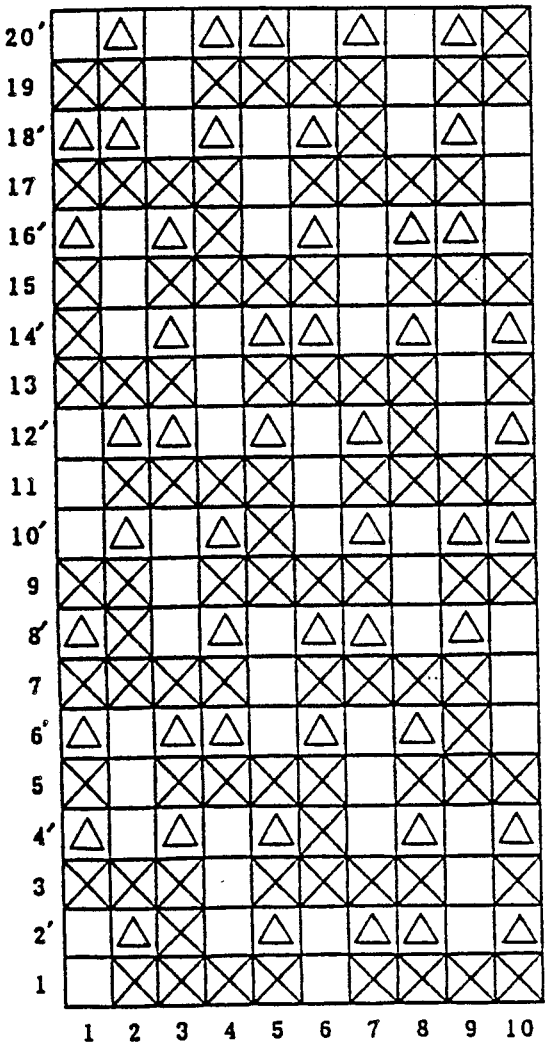

FIG. 25 shows another embodiment of the invention according to which the auxiliary wefts are disposed one by one in juxtaposition with the intrinsic wefts, respectively, in a 10-shaft 4/1 satin woven fabric, and FIG. 26 shows still another embodiment of the invention in which pairs of the auxiliary wefts are juxtaposed with the intrinsic wefts, respectively, in a 10-shaft 4/1 satin woven fabric.

Referring to FIG. 25, the auxiliary weft 6' is woven into the texture by the warp 9, pushed upwardly at five locations by the warps 1, 3, 4, 6 and 8, respectively, and disposed on the warps 1, 2, 3, 4, 5, 6, 7, 8 and 10 to form a flat surface area.

In the case of the fabric shown in FIG. 26, the auxiliary weft 5' is woven into the texture by the warp 6, pushed upwardly at five locations by the warps 1, 3, 5, 8 and 10, respectively, and disposed on the warps 1, 2, 3, 4, 5, 7, 8, 9 and 10 to form a flat surface area. On the other hand, the auxiliary weft 6' is woven into the texture by the warp 10, pushed upwardly at five locations by the warps 1, 3, 5, 6 and 8, respectively, and disposed on the warps 1, 2, 3, 4, 5, 6, 7, 8 and 9 to thereby form a flat surface.

Figure 27A:
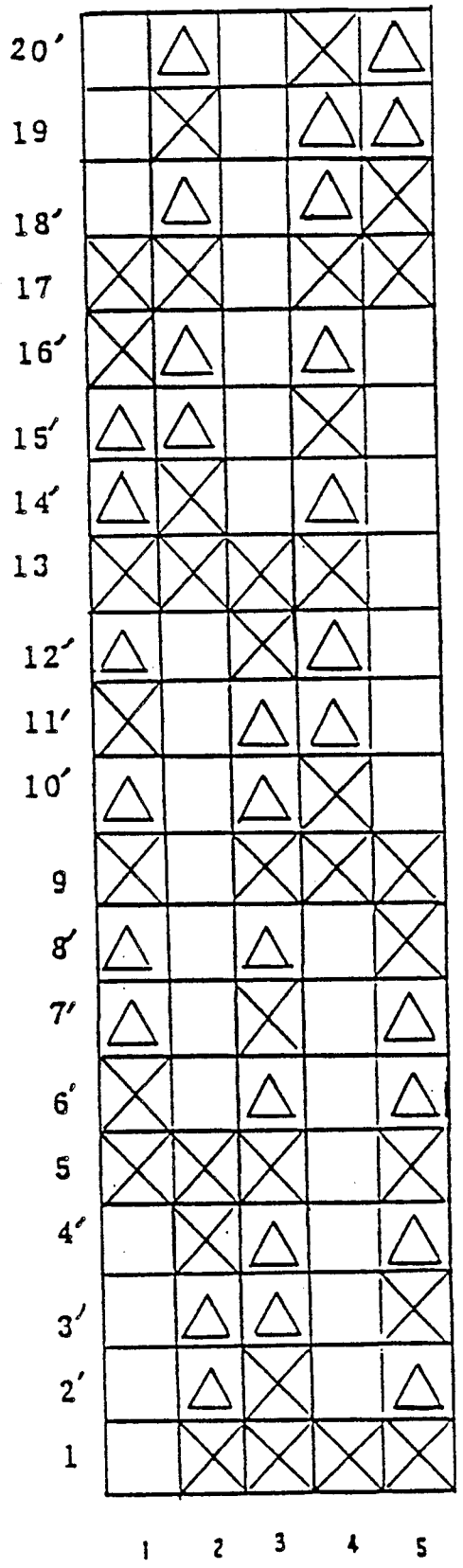
FIG. 27C shows a cross-sectional view of the papermaking fabric taken along the line XXVII–XXVII' in FIG. 27B.
Figure 27B:
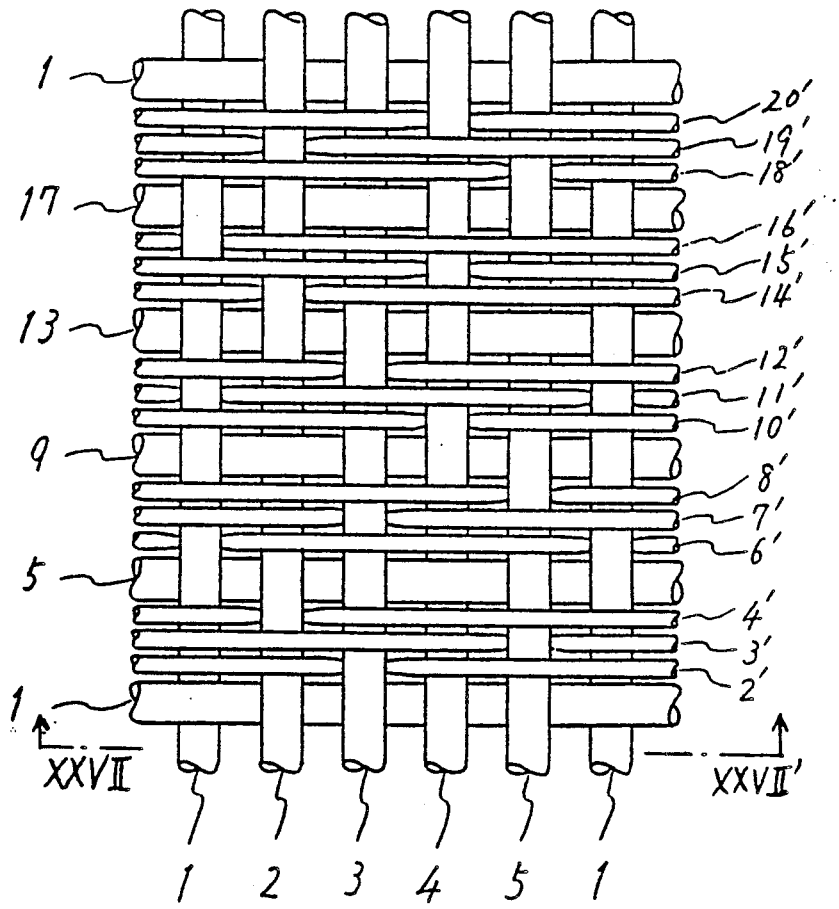
Figure 27C:
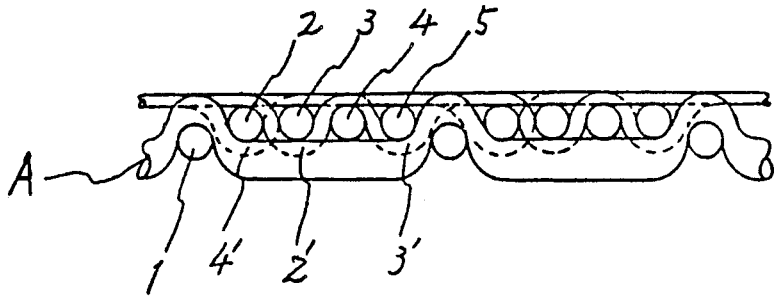

FIG. 27A through 27C show yet another embodiment of the invention according to which triplets of auxiliary wefts are disposed in juxtaposition with the intrinsic wefts, respectively, in the woven fabric of the texture shown in FIG. 12. More specifically, triplets of the auxiliary wefts 2'; 3'; 4', 6'; 7'; 8', 10'; 11'; 12', 14'; 15'; 16', and 18'; 19'; 20' are juxtaposed with the wefts 1, 2, 3, 4 and 5, respectively, in the fabric of the texture shown in FIG. 12. Paying attention to the auxiliary wefts 2', this weft is woven once into the texture by the warp 3, pushed upwardly by the warps 2 and 5 and disposed on the warps 1, 2, 4 and 5 in the fabric of the texture shown in FIG. 12 to form a flat surface area.

In the foregoing description of the various embodiments of the invention, the flat surface formed by the auxiliary wefts constitutes the papermaking surface of the fabric, which is thus imparted with flatness and smoothness.

FIG. 2C is a cross-sectional view taken along the weft 1 or the line II-II' in FIG. 2B for illustrating the disposition of the auxiliary weft, wherein a reference character A in FIG. 2C represents the weft 1 in FIGS. 2A and 2B. Warps 1 to 4 in FIG. 2C each shown in a cross section correspond, respectively, to the warps 1 to 4 shown in FIGS. 2A and 2B. The warp 1 is disposed beneath the weft A with the warps 2, 3 and 4 being disposed on the weft A. It can be seen that the auxiliary weft 2' is woven into the texture by the warp 2 and disposed on the warps 1, 3 and 4 to form a flat surface.

FIG. 6C is a cross-sectional view taken along the weft 1 or the line VI—VI' in FIG. 6B for illustrating the disposition of the auxiliary weft, wherein a reference character A in FIG. 6C represents the weft 1 in FIGS. 6A and 6B. Warps 1 to 4 in FIG. 6C each shown in a cross section correspond, respectively, to the warps 1 to 4 shown in FIGS. 6A and 6B. The warp 1 is disposed beneath the weft A with the warps 2, 3 and 4 being disposed on the weft A. It can be seen that the auxiliary weft 2' is woven into the texture by the warp 1 and disposed on the warps 2, 3 and 4 to form a flat surface.

FIG. 10C is a cross-sectional view taken along the weft 1 or the line X—X' in FIG. 10B for illustrating the disposition of the auxiliary eft, wherein a reference character A in FIG. 10C represents the weft 1 in FIGS. 10A and 10B. Warps 1 to 5 in FIG. 10C each shown in a cross section correspond, respectively, to the warps 1 to 5 shown in FIGS. 10A and 10B. The warps 1 and 3 are disposed beneath the weft A with the warps 2, 4 and 5 being disposed on the weft A. It can be seen that the auxiliary weft 2' is woven into the texture by the warp 3 and disposed on the warps 1, 2, 4 and 5 to form a flat surface.

FIG. 13C is a cross-sectional view taken along the weft 1 or the line XIII—XIII' in FIG. 13B for illustrating the disposition of the auxiliary weft, wherein a reference character A in FIG. 13C represents the weft 1 in FIGS. 13A and 13B. Warps 1 to 5 in FIG. 13C each shown in a cross section correspond, respectively, to the warps 1 to 5 shown in FIGS. 13A and 13B. The warp 1 is disposed beneath the weft A with the warps 2, 3, 4 and 5 being disposed on the weft A. It can be seen that the auxiliary weft 2' is woven into the texture by the warp 2 and disposed on the warps 1, 3, 4 and 5 to form a flat surface.

FIG. 18C is a cross-sectional view taken along the weft 1 or the line XVIII-XVIII' in FIG. 18B for illustrating the disposition of the auxiliary weft, wherein a reference character A in FIG. 18C represents the weft 1 in FIG. 18A and 18C. Warps 1 to 5 in FIG. 18C each shown in a cross section correspond, respectively, to the warps 1 to 5 shown in FIGS. 18A and 18B. The warp 1 is disposed beneath the weft A with the warps 2, 3, 4 and 5 being disposed on the weft A. It can be seen that the auxiliary weft 2' is woven into the texture by the warp 5 and disposed on the warps 1, 2, 3 and 4 to form a flat surface. On the other hand, the auxiliary weft 3' is woven into the texture by the warp 2 and disposed on the warps 1, 3, 4 and 5, thereby forming a flat surface.

FIG. 20C is a cross-sectional view taken along the weft 1 or the line XX-XX' in FIG. 20B for illustrating the disposition of the auxiliary weft, wherein a reference character A in FIG. 20C represents the weft 1 in FIGS. 20A and 20B. Warps 1 to 6 in FIG. 20C each shown in a cross section corresponding, respectively, to the warps 1 to 6 shown in FIGS. 20A and 20B. The warps 1 and 4 are disposed beneath the weft A with the warps 2, 3, 5 and 6 being dispsoed on the weft A. It can be seen that the auxiliary weft 2' is woven into the texture by the warp 2 and disposed on the warps 1, 3, 4, 5 and 6 to form a flat surface.

FIG. 23C is a cross-sectional view taken along the weft 1 or the line XXIII—XXIII' in FIG. 23B for illustrating the disposition of the auxiliary weft, wherein a reference character A in FIG. 23C represents the weft 1 in FIGS. 23A and 13B. Warps 1 to 8 in FIG. 23C each shown in a cross section correspond, respectively, to the warps 1 to 8 shows in FIGS. 23A and 23B. the warps 1, 4, 5 and 8 are disposed beneath the weft A with the warps 2, 3, 6 and 7 being disposed on the weft A. It can be seen that the auxiliary weft 2' is woven into the texture by the warp 2 and disposed on the warps 1 and 3 to 8 to form a flat surface.

FIG. 27C is a cross-sectional view taken along the weft 1 or the line XXVII-XXVII' in FIG. 27B for illustrating the disposition of the auxiliary wefts, wherein a reference character A in FIG. 27C represents a weft 1 in FIGS. 27A and 27B. Warps 1 to 5 in FIG. 27C each shown in a cross section correspond, respectively, to the warps 1 to 5 shown in FIGS. 27A and 27B. The warp 1 is disposed beneath the weft A with the warps 2, 3, 4 and 5 being disposed on the weft A. It can be seen that the auxiliary weft 2' is woven into the texture by the warp 3 and disposed on the warps 1, 2, 4 and 5, the auxiliary weft 3' is woven into the texture by the warp 5 and disposed on the warps 1, 2, 3 and 4, and the auxiliary weft 4' is woven into the texture by the warp 2 and disposed on the warps 1, 3, 4 and 5 thereby forming a flat surface.

EXAMPLE 1

The cloth shown in FIGS. 13A through 13C is woven by using yarns listed in the undermentioned table 1 which shows the operation and effects of the resultant woven fabric in comparison with those of a prior art 2/2 twill woven fabric.

TABLE 1

| TEXTURE | EXAMPLE 1 4/1 SATIN WEAVE | EXAMPLE 2 2/2 TWILL WEAVE |
|---|---|---|
| Warp (mm) | 0.25 | 0.25 |
| Weft (mm) | 0.30 | 0.30 |
| Auxiliary weft (mm) | 0.15 | |
| Number of warps (/inch) | 58 | 58 |
| Total number of wefts (/inch) | 90 | 38 |
| Water drainage time (sec.)* | 4.5 | 5.3 |
| Yield (%)** | 73 | 61 |

TABLE 1-continued

| TEXTURE | EXAMPLE 1 4/1 SATIN WEAVE | EXAMPLE 2 2/2 TWILL WEAVE |
|---|---|---|
| Abrasion time*** | 33 | 21 |

Notes:
*Time taken by pulp slurry of 0.04 concentration containing 170 ml of freeness of defiberlized newspaper and having a water level of 300 mm until it is reduced to zero upon flowing down along a cloth disposed with inclinatioh of 15' to the vertical.
**(Weight of manufactured paper/weight of charged pulps) × 100 = yield (%).
***Time taken for the fabric to be broken by abrasion as measured by an abrasion tester commercially available from Nippon Filcon Co., Ltd. (Registered Utility Model No. 1350124).

Parenthetically, heavy calcium carbonate was employed as filler.

EXAMPLE 2

The cloth shown in FIGS. 18A through 18C is woven by using yarns listed in the undermentioned table 2 which shows the operation and effects of the resultant woven fabric in comparison with those of a prior art 3/1 satin woven fabric.

TABLE 2

| TEXTURE | EXAMPLE 2 4/1 SATIN WEAVE | PRIOR ART 3/1 SATIN WEAVE |
|---|---|---|
| Warp (mm) | 0.25 | 0.25 |
| Weft (mm) | 0.27 | 0.27 |
| Auxiliary weft (mm) | 0.12 | |
| Number of warps (/inch) | 58 | 58 |
| Total number of wefts (/inch) | 120 | 43 |
| Water drainage time (sec.)* | 4.9 | 6.4 |
| Yield (%)** | 84 | 66 |
| Abrasion time*** | 31 | 25 |

Notes:
*Time taken by pulp slurry of 0.04 concentration containing 170 ml of freeness of defiberlized newspaper and having a water level of 300 mm until it is reduced to zero upon flowing down along a cloth disposed with inclination of 15' to the vertical.
**(Weight of manufactured paper/weight of charged pulps) × 100 = yield (%).
***Time taken for the fabric to be broken by abrasion as measured by an abrasion tester commercially available from Nippon Filcon Co., Ltd. (Registered Utility Model No. 1350124).

Parenthetically, heavy calcium carbonate was employed as filler.

As will now be appreciated from the foregoing description, the papermaking fabrics according to the present invention enjoy excellently high paper material retention capability, improved drainage property and high abrasion resistance capability without being attended by generation of the wire marks and water spilling.

What is claimed is:

1. A single-layer papermaking woven fabric having a paper side and a running side and formed of warps and primary and auxiliary wefts and having more than four shafts in each repeating unit, where, in a repeating unit, at least one auxiliary weft having a smaller diameter than that of said primary weft is disposed essentially parallel with each of said primary wefts and between each primary weft, said auxiliary weft being over at least two adjacent warps, each of said auxiliary weft being woven only once into each unit by a warp, wherein each auxiliary weft is pushed or urged upwardly at two or more portions of each repeating unit by said warps to thereby form a flat, smooth surface on the paper side.

2. A single-layer papermaking woven fabric as set forth in claim 1, wherein one auxiliary weft is disposed for each of the primary wefts.

3. A single-layer papermaking woven fabric as set forth in claim 1, wherein a plurality of said auxiliary wefts are disposed for each of said primary wefts.

4. A single-layer papermaking woven fabric according to claim 1, wherein the running side is formed of long crimped primary wefts.

5. A single-layer papermaking woven fabric according to claim 4, wherein one auxiliary weft is disposed for each of the primary wefts.

6. A single-layer papermaking woven fabric according to claim 4, wherein a plurality of said auxiliary wefts are disposed for each of said primary wefts.

* * * * *